United States Patent [19]

Morimoto

[11] Patent Number: 4,745,979

[45] Date of Patent: May 24, 1988

[54] METHOD AND APPARATUS FOR DRIVING DRAIN BOARD

[75] Inventor: Tatsuo Morimoto, Ashiya, Japan

[73] Assignees: Kazuko Morimoto; Mayumi Morimoto; Kayoko Imajo, all of Hyogo, Japan

[21] Appl. No.: 828,779

[22] Filed: Feb. 12, 1986

[30] Foreign Application Priority Data

Feb. 14, 1985 [JP] Japan ..... 60-26715

[51] Int. Cl.[4] ..... E02B 11/00

[52] U.S. Cl. ..... 173/22; 173/49; 405/50

[58] Field of Search ..... 173/49, 22, 128; 175/55, 56; 405/50, 36

[56] References Cited

U.S. PATENT DOCUMENTS

| | | | |
|---|---|---|---|
| 3,881,319 | 5/1975 | Katagiri et al. | 405/50 |
| 3,973,408 | 8/1976 | Paverman | 173/49 |
| 4,428,699 | 1/1984 | Juhola | 405/50 |
| 4,622,138 | 11/1986 | Wager | 405/50 |

FOREIGN PATENT DOCUMENTS

| | | | |
|---|---|---|---|
| 156313 | 12/1981 | Japan | 405/50 |
| 150816 | 8/1984 | Japan | 405/50 |
| 215914 | 10/1985 | Japan | 405/50 |

*Primary Examiner*—E. R. Kazenske
*Assistant Examiner*—James L. Wolfe
*Attorney, Agent, or Firm*—James H. Tilberry

[57] ABSTRACT

This invention relates to a method and apparatus for simultaneously driving a plurality of drain boards, radially aligned about a common center, to stabilize and improve terrestrial and submarine foundation soils and submarine soils. This method, using standard width drain boards, can cover a wide absorption and drain area with a relatively small number of drain board driving operations.

4 Claims, 9 Drawing Sheets

METHOD AND APPARATUS FOR DRIVING DRAIN BOARD

BACKGROUND OF THE INVENTION

1. Field of the Invention

This invention relates to a method and apparatus for embedding drain boards, which can expand the diameter of an effective drain circle to achieve the maximum improvable effect with a relatively small number of embodiments in submarine foundations, coastal reclaimed land or the like needing improvements on foundations of the depths.

2. Description of the Prior Art

Conventionally, as shown in FIG. 1, a general drain board used for improving foundations is a strip-like body having a section of about several mm thickness and 10 cm width and constituted from a base plate 3 having on both surfaces a continuous groove 2 and non-woven fabrics 4,4 having water permeability and secured to the surfaces of the base plate 3.

Also, since the time required for embedding and withdrawing such drain boards to be used for draining deep submarine foundations must be greater than that for improving shallow foundations, a concept of expanding the diameter of the effective drain circle by substantially enlarging the width of the board has been developed.

The effective drain circle means the size of absorption and drain range in which the drain board driven into the ground can take charge of and which is represented by the section as shape centering around the board. Since a general sand drain or the like itself has a circular section, said circle has a circular section. However, since the drain board is plate-shaped, it is found from the measurement of isobaric level of absorption and drain as shown in FIG. 2 that said circle becomes actually plate-shaped at a position near the board, gradually elliptic as it is spaced from the board, and approximately circular as it is further spaced from the board.

This is caused by the directional properties of absorption and drainage inherent in the board itself and such properties increase as the width of the board is increased. That is, as shown in FIG. 2, while the isobaric lines E of absorption and drainage of the drain board 1 resemble a circle as they are spaced farther from the board, the absorption and drainage potential is higher along the isobaric lines closer to the board. Thus, the directional properties of this plate-shaped circle present a problem which cannot be neglected, particularly in using a board of large width.

Thus, the maximum width of the board which has been heretofore considered optimum for embedment has been 20 cm–25 cm. With the width exceeding 20 cm–25 cm, the effective drain circles of drain boards embedded at equal intervals into the foundation do not properly overlap each other, with the consequence that irregular drainage may take place.

In addition to such a phenomenon, the portion of a mandrel for driving the large width board into a submarine foundation is plate-shaped like the drain board, so that from a structural point of view its strength is limited, as well as the board itself, which, because of lack of strength, should be limited to about 25 cm in width in order to avoid problems of twist, hanging-up, etc. A board having a width as large as 50 cm was considered to be out of the question.

In summary, since it was conventional wisdom to believe that the capacity of a drain board could be increased only by increasing the width of the drain board, the capacity of the drain board was inherently limited.

SUMMARY OF THE INVENTION

The method of embedding a drain board according to the present invention is characterized in that a plurality of radially arrayed, evenly spaced strip-like drain boards are simultaneously driven into the foundation.

An apparatus for driving the drain board according to the present invention is characterized in that elongate mandrels have holes through which the strip-like drain boards are inserted, wherein the mandrels drive the drain boards into the foundation.

According to this method, a plurality of drain boards are driven simultaneously in a body to form a wide and effective drain surface wherein a wide absorption and drain area can be covered by a small number of drain board embedding operations.

The above-mentioned and other objects and features of the invention will become apparent from the following detailed description taken in conjunction with the drawings which indicate embodiments of the invention.

BRIEF DESCRIPTION OF THE DRAWINGS

FIG. 20(*b*) shows the drain board of FIG. 20(*a*) temporarily fixed to an arm.

DESCRIPTION OF THE PREFERRED EMBODIMENTS

Figure 1:
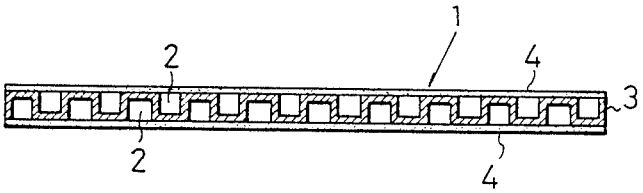
FIG. 1 is a sectional view showing a drain board.
Figure 2:
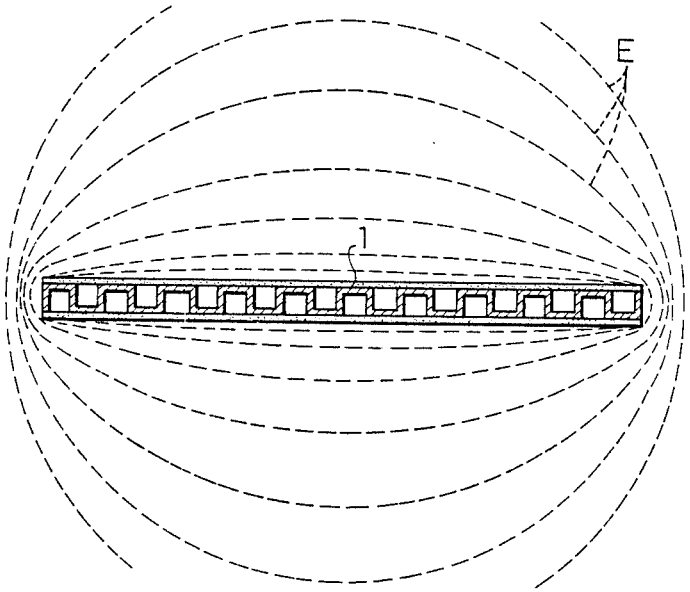
FIG. 2 shows the isobaric lines of absorption and drain encircling a drain board.
Figure 3A:
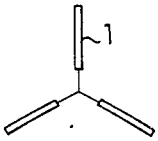
FIGS. 3(*a*), (*b*), (*c*) and (*d*) are schematic plan views of three, four, five and six radially arrayed drain boards.
Figure 3B:
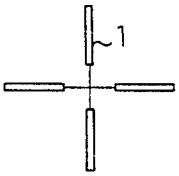
Figure 3C:
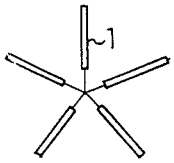
Figure 3D:
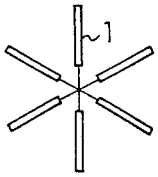
Figure 4:
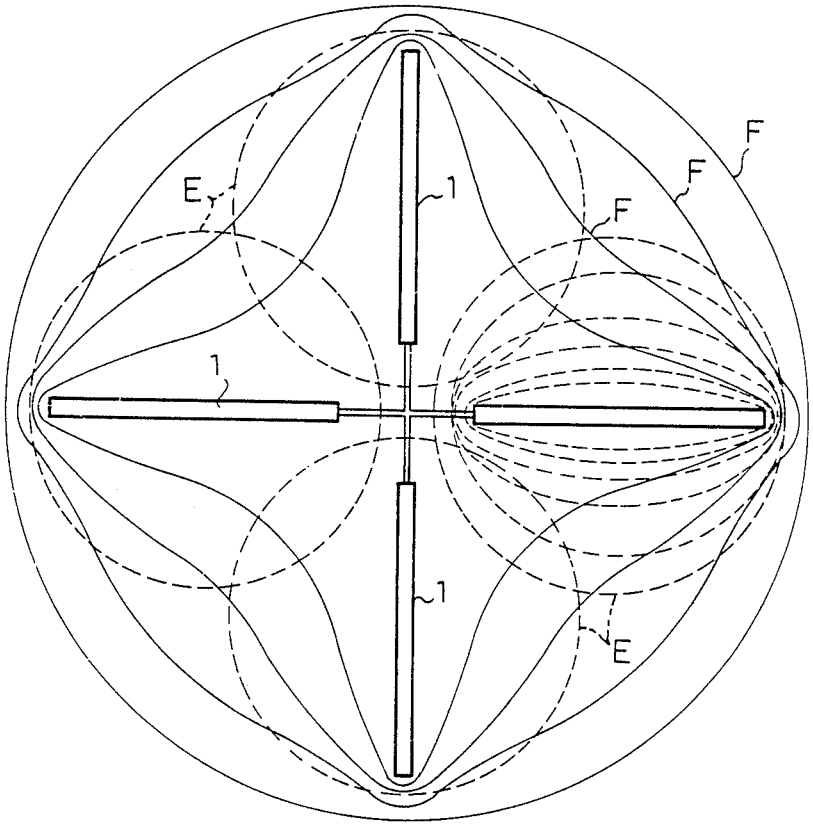
FIG. 4 shows the isobaric lines formed by four radially arrayed drain boards.

Referring now to the drawings in greater detail, FIG. 4 shows the isobaric lines formed en bloc by radially arrayed drain boards 1 equidistantly spaced apart and driven into the ground. FIGS. 3(*a*), (*b*), (*c*) and (*d*) show embodiments of the drain boards oriented respectively in three directions at 120° angular intervals, four directions at 90° angular intervals and five directions at 72° angular intervals. By thus driving a plurality of radially arrayed drain boards, the diameter of the effective drain circle can be expanded remarkably. That is, when four drain boards 1 are driven in four directions at 90° intervals, for example, the effective drain circle becomes as shown in FIG. 4 and the isobaric lines E of absorption and drain of the respective individual drain boards are collected to form a group of isobaric lines F of absorption and drain. These isobaric lines F have little shade and overlap portions where the absorption and drain potential is remarkably low and efficiently form a generally circular drain circle.

When the drain circle thus formed by a plurality of drain boards in a body is converted to the sand pile conversion diameter, for example assuming that four 25 cm wide drain boards are used, the total length of the peripheral surface $=0.25\text{ m}\times 2\times 4=2\text{ m}$. When the conversion diameter is obtained by assuming the sand pile conversion factor $\alpha=1$, $2\text{ m}\times\alpha/\pi=2\times\frac{1}{3}.14=0.64\text{ m}$, i.e., the same effect is obtained as that of driving a 60 cm sand pile.

Figure 5:
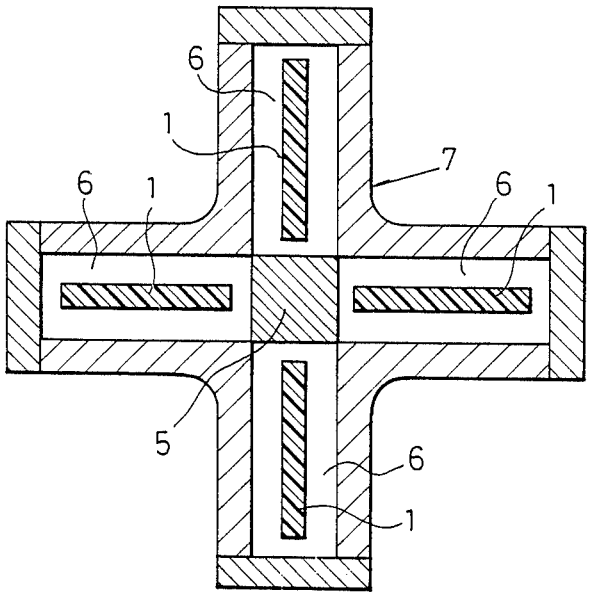
FIG. 5 is a sectional view showing a mandrel having four drain board securing holes.

For example, as shown in FIG. 5, the apparatus for driving a cruciform of four drain boards into the foundation comprises a long mandrel 7 having holes 6 through which four drain boards having rectangular cross sections are inserted. The drain boards 1 are inserted respectively through the through holes 6 and the mandrel 7 is driven into the ground and withdrawn leaving the drain boards 1 embedded.

Figures 6, 7:
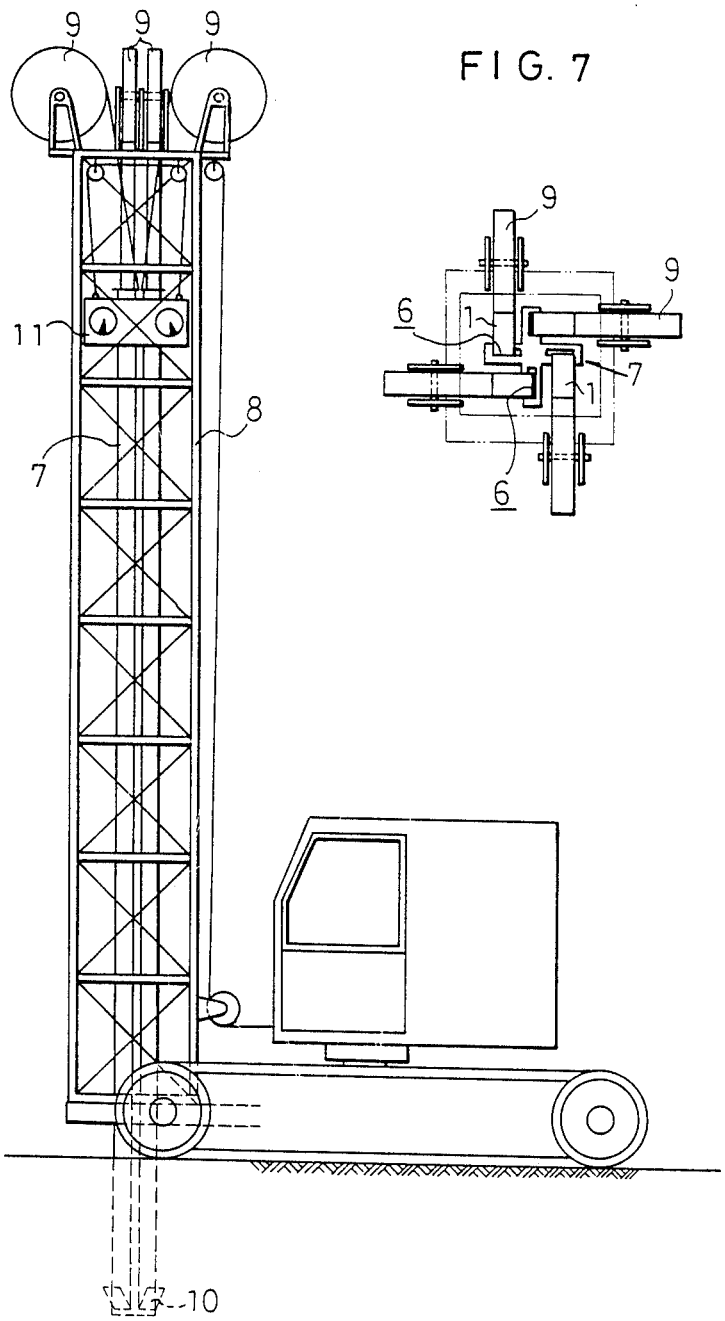
FIG. 6 is an elevational view showing an apparatus for driving drain boards.
FIG. 7 is a plan view showing the mandrel portion of the apparatus of FIG. 6.

FIGS. 6 and 7 show an embodiment of the driving apparatus. A plurality of cruciform mandrels 7 having through holes 6 are interconnected to a predetermined length and erected vertically in tower 8. The drain boards 1 respectively wound around rolls 9 are inserted through the four through holes 6 and at the same time shoes 10 are mounted on the end of the drain boards 1 projecting from the lower end of the through holes 6.

The upper end of the mandrel 7 is vibrated under such condition by a vibration driving apparatus 11 mounted on the upper portion of the tower 8 to drive the mandrel 7 to a predetermined depth. After the completion of withdrawing the mandrel, the drain boards 1 are cut off at about 30 cm, for example, from the surface of the earth and the mandrel 7 is withdrawn upward. At that time, the shoes 10 mounted on the end of the drain boards 1 are anchored in the ground to secure the drain boards 1 in the ground. The four drain boards 1 driven into the ground are left radially arrayed and angularly equidistant one from the other.

Figure 8:
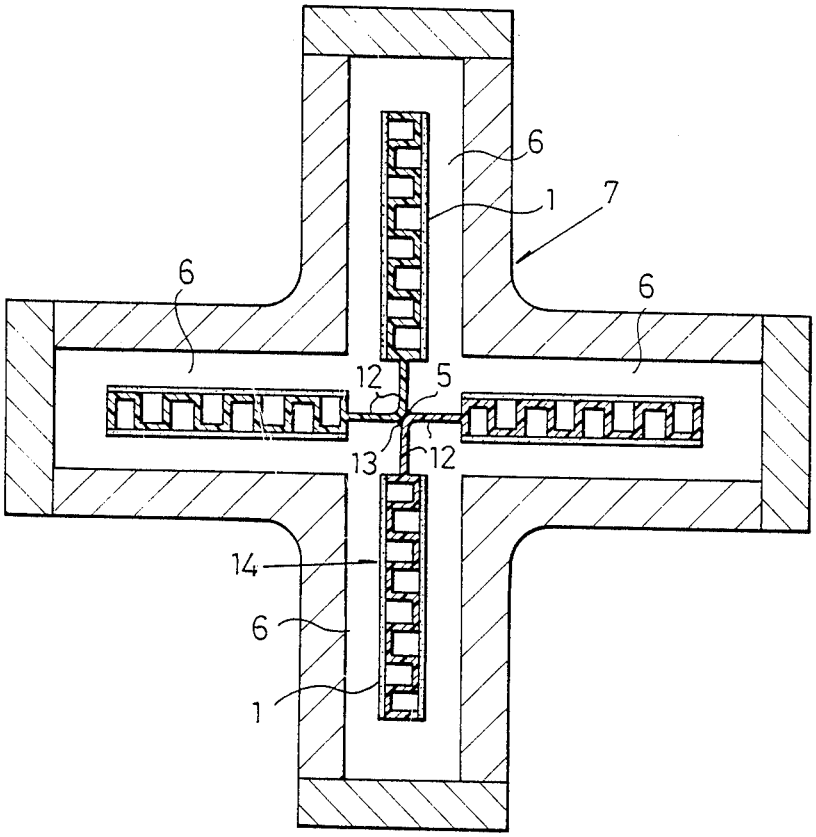
FIG. 8 is a horizontal sectional view showing a mandrel with four through holes communicating with each other in the center axis portion of the mandrel.
Figure 9:
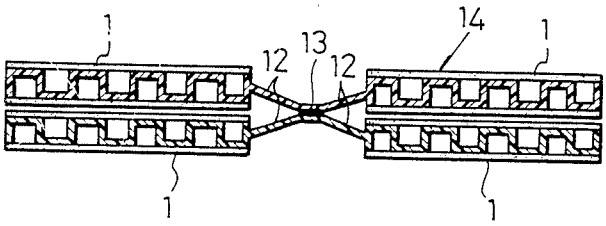
FIG. 9 is a sectional view showing an aggregate of four drain boards connected to each other.

As shown in FIG. 8, the through holes in the mandrel may communicate with each other. That is, for example, in the case of the mandrel for driving four drain boards, the four through holes 6 may communicate with each other at the intersection of the cruciform. In this case, as shown in FIGS. 8 and 9, a strip-like joint 12 is mounted on each side edge of a plurality of, for example four drain boards 1, and these four strip-like joints are secured to each other so that drain board aggregate 14 may be used to radially deploy the respective drain boards 1.

Figure 14:
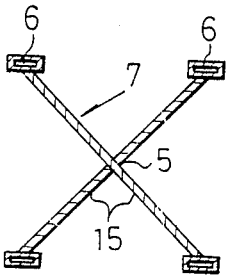

Also, according to the present invention, the use of the mandrels having cross-sectional configurations as shown in FIGS. 11, 12, 13 and 14 may be used to drive drain boards 1. Mandrels 7 are interconnected by brackets consisting of a plurality of strip-like steel plates 15 which are oriented radially and equally spaced apart about a center axis 5. Mandrels 7 are provided with through holes 6 for receiving the drain boards therein. The mandrels 7 shown in FIGS. 11, 12 have their through holes 6 oriented radially. The mandrel 7 shown in FIG. 13 has its through holes 6 oriented at right angles to the interconnecting brackets 15. FIG. 14 shows the through holes 6 oriented parallel to each other.

Figure 15:
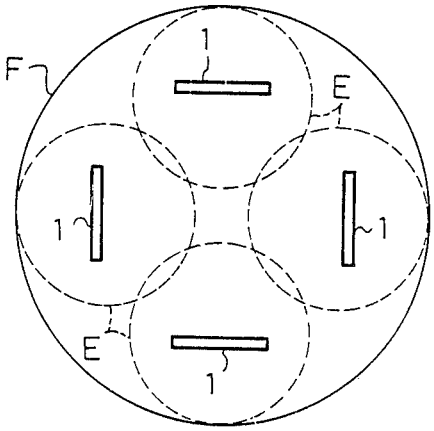
FIGS. 15 and 16 show the isobaric lines formed by four rectangularly arrayed drain board surfaces.
Figure 16:
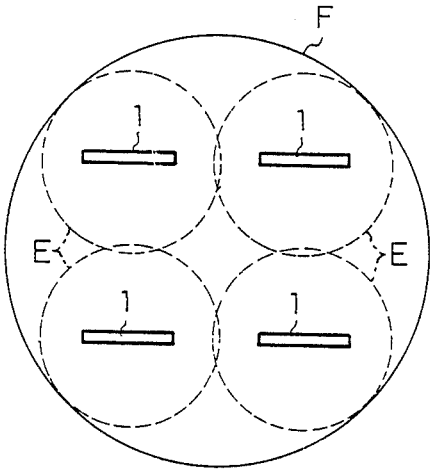

By the use of any of the mandrels shown in FIGS. 11, 12, 13 and 14, drain boards 1 can be simultaneously driven into the foundation in a plurality of geometrical alignments. A plurality of drain boards 1 thus simultaneously driven collect the isobaric lines F of respective individual drain boards 1 as shown in FIGS. 15 and 16, similar to those in FIG. 4. Also, in this case, the isobaric lines have little shade and overlap portions to provide a generally circular and large effective drain circle. Thus, a wide drain area can be covered with a small number of drives so that the foundation can be improved very efficiently.

Figure 10:
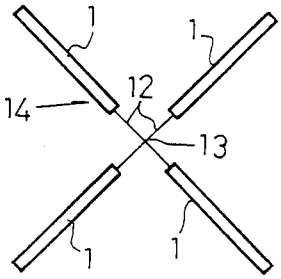
FIG. 10 schematically shows a radial development of the drain boards of FIG. 9.
Figure 11:
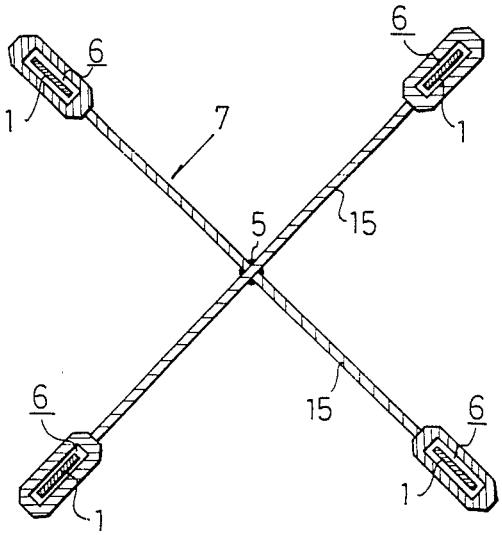
FIGS. 11, 12, 13 and 14 are horizontal sectional views showing four embodiments of mandrels having steel plate brackets radially oriented and provided on their ends with through holes.
Figure 12:
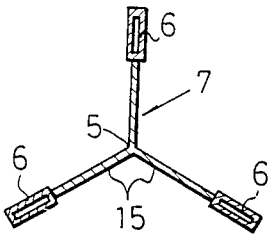
Figure 13:
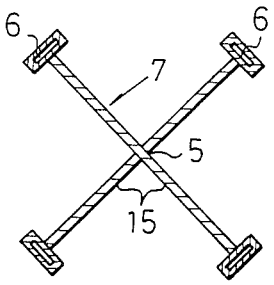
Figure 17:
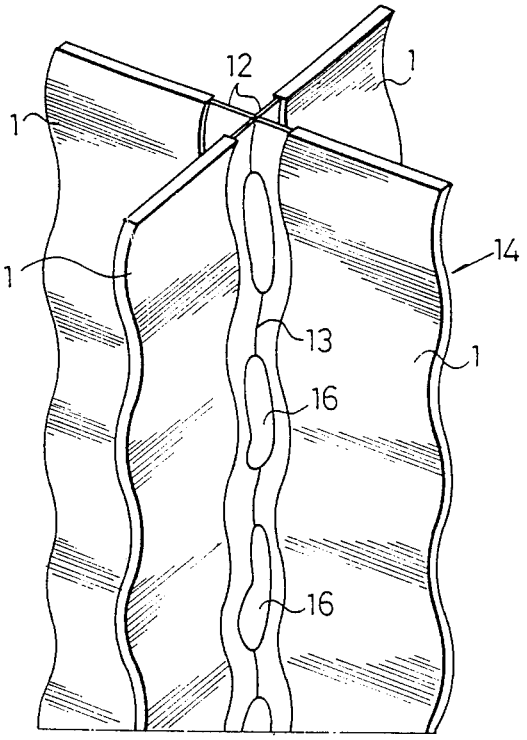
FIG. 17 is a perspective view showing a cruciform corrugated drain board having the intersection provided with through holes.

A plurality of drain boards driven simultaneously into the foundation according to the present invention expand and contract to draw a usual wave form corresponding to the advance of improvement on the foundation and the contraction of same. In this case, if the respective drain boards are not interconnected through the joints or the like, they can expand and contract to adapt to the contraction of the foundation without acting on each other. However, as shown in FIGS. 9 and 10, in the case of the aggregate 14 of a plurality of drain boards 1 interconnected by strip-like joints 12 in a body, since the strip-like joints 12 extend radially about the center line 13, they cannot expand and contract following the transformation unless the joints 12 are of flexible material having large expansibility. Thus, a large force acts on the base plate 3 of the drain boards so that the base plate 3 is subjected to buckling and breakage to make drain through grooves 2 impossible. Hence, the flexible material is used for the joint 12, while resistance to the transformation of the drain board into the wave form is preferably reduced when for example elliptic slots 16 are provided along the center line 13 of the joints 12, as shown in FIG. 17.

Figure 18:
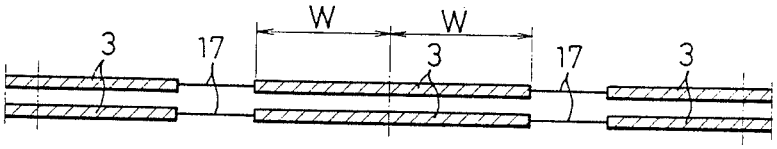
FIG. 18 is a sectional view showing a process for preparing the drain board aggregate.

The drain boards 1 usually used according to the present invention are constituted from the base plates 3 of thermoplastic synthetic resin molding such as polyethylene or polypropylene and the surface of nonwoven fabric 4 of synthetic fiber such as nylon, ester and polypropylene. In the case of such drain boards, since the thermoplastic resin base plates 3 are generally molded with the width of about 1–2 m, as shown in FIG. 18, portions of the base plates 3 at predetermined widthwise interval positions are heated and rolled to form seat sections 17 having a predetermined width, and two overlapping base plates 3 are fused fixedly to each other along the central portions of the seat sections 17, while the base plates 3 are cut off by a predetermined width (W) so that the agregate 14 can be formed of four drain boards interconnected to be developed radially in a body around a straight line similar to that in FIG. 10.

Further, the drain boards are not necessarily limited to that formed of the base plates and non-woven fabric. It may be formed of a material having water permeability as a whole. Usually, it is preferable to use a member having large expansibility rather than the base plates for the joint.

Figure 19:
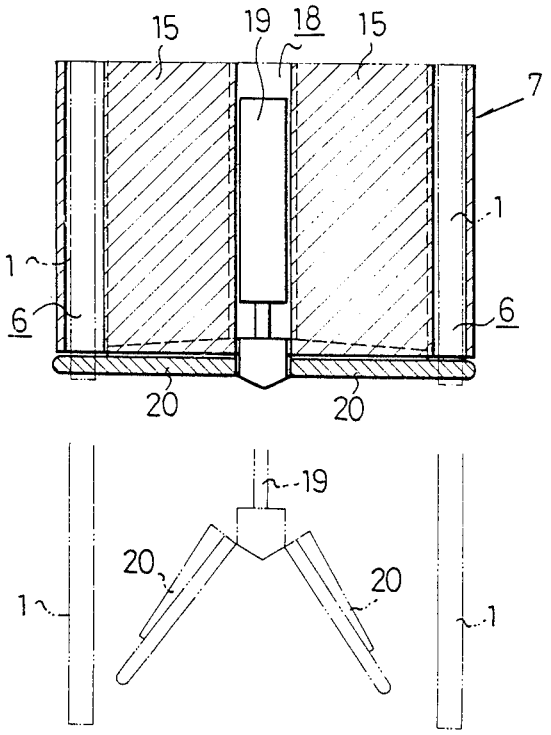
FIG. 19 is a fragmentary, sectional view showing a drain board depressing unit mounted on the lower end of the mandrel.

When a plurality of drain boards are simultaneously driven by this apparatus, a board depressing unit is preferably mounted on the lower end of the mandrel 7. FIG. 19 shows an embodiment of this depressing unit provided with a hollow portion 18 opened downward in the lower end of the center axis of the mandrel 7 to which the side edges of a plurality of steel plates 15 of the mandrel are collectively fixedly secured. A hydraulic or pneumatic cylinder 19 is attached to the interior of this hollow portion 18, and arms 20 extending to the lower end of the through hole 6 are attached to the end of the cylinder 19 along the lower end surface of the steel plate 15 to be pivotable downward while the arms 20 are depressed.

Figure 20A:
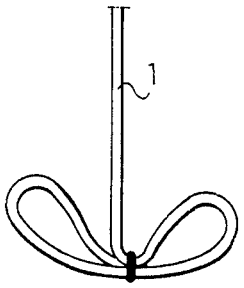
FIG. 20(*a*) is a fragmentary elevational view showing the end of a drain board bent in the form of a pair of closed loops.
Figure 20B:
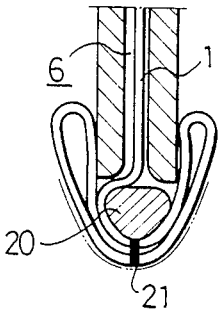

In this depressing unit, the end of the drain board 1 inserted into the through hole 6 is bent in the form of a double closed loop as shown in FIG. 20(*a*) and temporarily attached to the arm 20 by a Hotchkiss grommet 21 or the like, as shown in FIG. 20(*b*). When the arm 20 is depressed downward and at the same time pivoted after the mandrel 7 is driven to a predetermined depth, the lower end of the drain board 1 gets out of the arm 20 and is pushed into the lower foundation so that the bend of the board can be anchored in the ground to leave the drain board 1 in the ground even when the mandrel 7 is withdrawn. Further, on the end of the drain board may be mounted a shoe of rubber, plastic or the like having a V-shaped section to be temporarily attached to the arm.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. Apparatus for simultaneously driving a plurality of vertical drain boards having upper and lower ends into a foundation soil comprising a derrick; a hollow vertical mandrel having upper and lower ends suspended from said derrick having a like plurality of longitudinal through-slots each adapted to receive a drain board therethrough; means to releasably secure the lower ends of said drain boards adjacent the lower end of said mandrel; means to drive said mandrel with said drain boards into a foundation soil; means to actuate said releasable means to disengage said lower ends of said drain boards from said releasable means; means to rotatably mount a plurality of drain board coils on the top of said derrick with each coil positioned adjacent a through-slot to feed lead ends of the drain board coils into and downwardly inside said through slots to the lower end of said mandrel; said releasable means comprising an actuator, a plurality of arms pivotally secured to said actuator and securable to the lead ends of said plurality of drain board coils; and means to pivot said arms downwardly, whereby said mandrel may be withdrawn from said foundation soil while leaving said drain boards in place in said foundation soil; and whereby upward shifting of said mandrel disengages said arms from the lead ends of said drain board coils.

2. The apparatus of claim 1, wherein said arms have inboard ends and outboard ends; said inboard ends being pivotally secured to said actuator to cantilever said arms radially outward for receiving the lower ends of said drain board coils thereabout; and whereby said lower ends of said drain board coils are releasable from said outboard ends when said arms are pivoted downwardly and said mandrel is shifted upwardly.

3. The apparatus of claim 2, including means to releasably loop said lower ends of said drain board coils about said arms.

4. The apparatus of claim 1, wherein said mandrel comprises a cross section of cruciform configuration to provide four radially disposed through-slots separated each from the others to enable four separated drain boards to be threaded through individual slots.

* * * * *